US006832441B2

(12) United States Patent
Jeong et al.

(10) Patent No.: US 6,832,441 B2
(45) Date of Patent: Dec. 21, 2004

(54) WASHING AND DRYING MACHINE AND METHOD FOR CONTROLLING DRYING PROCESS THEREOF

(75) Inventors: In Chul Jeong, Koyang-shi (KR); Kyung Chul Woo, Seoul (KR); Kyeong Hwan Kim, Puchon-shi (KR); Choon Myun Chung, Kwangmyong-shi (KR); Mu Yong Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/225,280

(22) Filed: Aug. 22, 2002

(65) Prior Publication Data

US 2003/0051370 A1 Mar. 20, 2003

(30) Foreign Application Priority Data

Sep. 19, 2001 (KR) ..... P2001-58017

(51) Int. Cl.[7] ..... F26B 5/08

(52) U.S. Cl. ..... 34/318; 34/602; 34/603; 34/604; 34/607; 68/19.2

(58) Field of Search ..... 34/318, 607, 602, 34/603, 67, 604; 68/19.2, 20, 19.1

(56) References Cited

U.S. PATENT DOCUMENTS 5,220,813 A * 6/1993 Chen et al. ..... 38/3
6,116,060 A * 9/2000 Strader ..... 68/20
6,282,928 B1 * 9/2001 Fukumoto et al. ..... 38/20

FOREIGN PATENT DOCUMENTS

CN 1231357 A 10/1999
JP 2000-271376 A 10/2000

* cited by examiner

*Primary Examiner*—Henry Bennett
*Assistant Examiner*—Camtu Nguyen
(74) *Attorney, Agent, or Firm*—Birch, Stewart, Kolasch & Birch, LLP

(57) ABSTRACT

Method for controlling a drying process of a washing and drying machine including a preheating step for tightly closing and heating an inner tub for preparing an environment favorable for vaporization of water by elevating a temperature of the inner tub within a short time period, and a drying step for supplying heated air to the inner tub, to make heat exchange between the heated air and laundry, for drying the laundry, whereby improving a drying performance and reducing occurrence of environmental problem.

18 Claims, 5 Drawing Sheets

| | | | |
|---|---|---|---|
| Drain Valve | OFF | ON | OFF |
| Air Supply Valve | OFF | OFF | OFF |
| Water Supply Valve | OFF | OFF | OFF |

WASHING AND DRYING MACHINE AND METHOD FOR CONTROLLING DRYING PROCESS THEREOF

This application claims the benefit of the Korean Application No. P2001-0058017 filed on Sep. 19, 2001, which is hereby incorporated by reference.

BACKGROUND OF THE INVENTION

1. Field of the Invention

The present invention relates to a washing and drying machine and a method for controlling the same, and more particularly to a washing and drying machine and a method for controlling a drying process thereof, which can minimize cause of environmental problem while a drying performance is improved.

2. Background of the Related Art

Of the washing machine, removing contaminants from laundry by applying an energy, such as impact and the like, there are a pulsator type washing machine, a drum type washing machine, and an agitator type washing machine depending on a type of energy application to the laundry. That is, the washing is done by applying impacts to the laundry by means of a pulsator, or an agitator, or by dropping the laundry by rotating a drum. Moreover, an action of detergent is added thereto, to make the washing done.

In general, the foregoing washing machines only have a washing function for washing laundry, such as clothes, to require taking out the laundry from the washing machine and drying under the sun.

Recently, owing to the wide spread apartment living, and change of living patterns, artificial fast drying of washed laundry is required, and to meet such a requirement, dryers are developed. The development of dryer facilitates convenient, and fast dry of the washed laundry.

However, in general, since the dryer has a size similar to the washing machine, installation of the washing machine and the dryer separately requires much space, and inconvenient in that the laundry, once washed, is required to be taken out of the washing machine and put into the dryer, again.

According to this, development of a washing machine having a drying function has been required. Eventually, in a drum type washing machine, a washing machine having a drying function is suggested, in which the laundry is dried in the drum in situ without transferring the laundry after completion of washing. However, the pulsator type or the agitator type washing machine, which in general has a better washing performance, has had no drying function. Accordingly, development of a pulsator type washing machine with a good washing performance and a drying function has been required.

SUMMARY OF THE INVENTION

Accordingly, the present invention is directed to a washing and drying machine and a method for controlling a drying process thereof that substantially obviates one or more of the problems due to limitations and disadvantages of the related art.

An object of the present invention is to provide a pulsator type washing and drying machine which can wash and dry laundry.

Another object of the present invention is to provide a method for controlling a drying process of a washing and drying machine, which can improve a drying function and reduce occurrence of environmental problem.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the method for controlling a drying process of a washing and drying machine includes a preheating step for tightly closing and heating an inner tub for preparing an environment favorable for vaporization of water by elevating a temperature of the inner tub within a short time period, and a drying step for supplying heated air to the inner tub, to make heat exchange between the heated air and laundry, for drying the laundry.

Preferably, the washing and drying machine includes a circulation duct for circulating air in the inner tub, a drain duct for draining washing water in the inner tub, and an air discharge duct for discharging excessively humid air in the inner tub, and the drying step includes a circulating type drying step for closing the drain duct to circulate the air from the inner tub to the inner tub again to dry laundry, and, on the same time, removing water vapor contained in the circulating air.

Preferably, the drying step further includes an excessively humid air discharge step for discharging a portion of the excessively humid air from the inner tub to outside through the air discharge duct at fixed intervals. Preferably, the excessively humid air discharge step includes the step of dropping a temperature and a humidity of the excessively humid air to be discharged.

Preferably, the drying step further includes a condensed water draining step for opening the drain duct at fixed intervals for draining condensed water produced in the drying step to outside.

Preferably, the drying step further includes an air discharge drying step for receiving external air through the circulation duct, and discharging the received air to outside of the washing machine through the inner tub directly.

The preheating step preferably includes a low speed rotating step for rotating the inner tub at a low speed, a high speed rotating step for rotating the inner tub at a high speed, and a stirring step for rotating the inner tub, periodically. The high speed rotating step more preferably includes the step of opening the drain duct.

The drying step includes the steps of circulating a portion of air from the inner tub to the inner tub again for drying the laundry, and discharging a portion of the air in the inner tub to an outside of the washing machine.

The air to be discharge to an outside of the washing machine is preferably subjected to regulation of a temperature and a humidity thereof. The regulation of a temperature and a humidity is preferably made by using external air introduced thereto, and the regulation of a temperature and a humidity is more preferably made by using cooling water introduced thereto.

Preferably, the drying step further includes an air discharge drying step for receiving external air, and discharging the received air to outside of the washing machine through the inner tub, directly. Preferably, no air is heated in the air discharge drying step.

The preheating step preferably includes a low speed rotating step for rotating the inner tub at a low speed, a high speed rotating step for rotating the inner tub at a high speed, and a stirring step for rotating the inner tub, periodically. The high speed rotating step more preferably includes the step of opening the drain duct.

In another aspect of the present invention, there is provided a washing and drying machine of a pulsator type including a drain duct connected to an underside of an outer tub, a circulation duct having one end positioned in the vicinity of an upper part of the outer tub, and the other end connected to the drain duct, a heater fitted to a predetermined location of the circulation duct for heating air flowing through the circulating duct, an air discharge duct having one end located in the vicinity of the upper part of the outer tub, and the other end connected to the drain duct, a fan fitted to a predetermined location of the air discharge duct for forced circulation of air, and temperature/humidity regulating means fitted to the air discharge duct for regulating temperature/humidity of the air flowing through the air discharge duct.

Thus, the present invention can improve a drying performance, and minimize an influence to an external environment.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
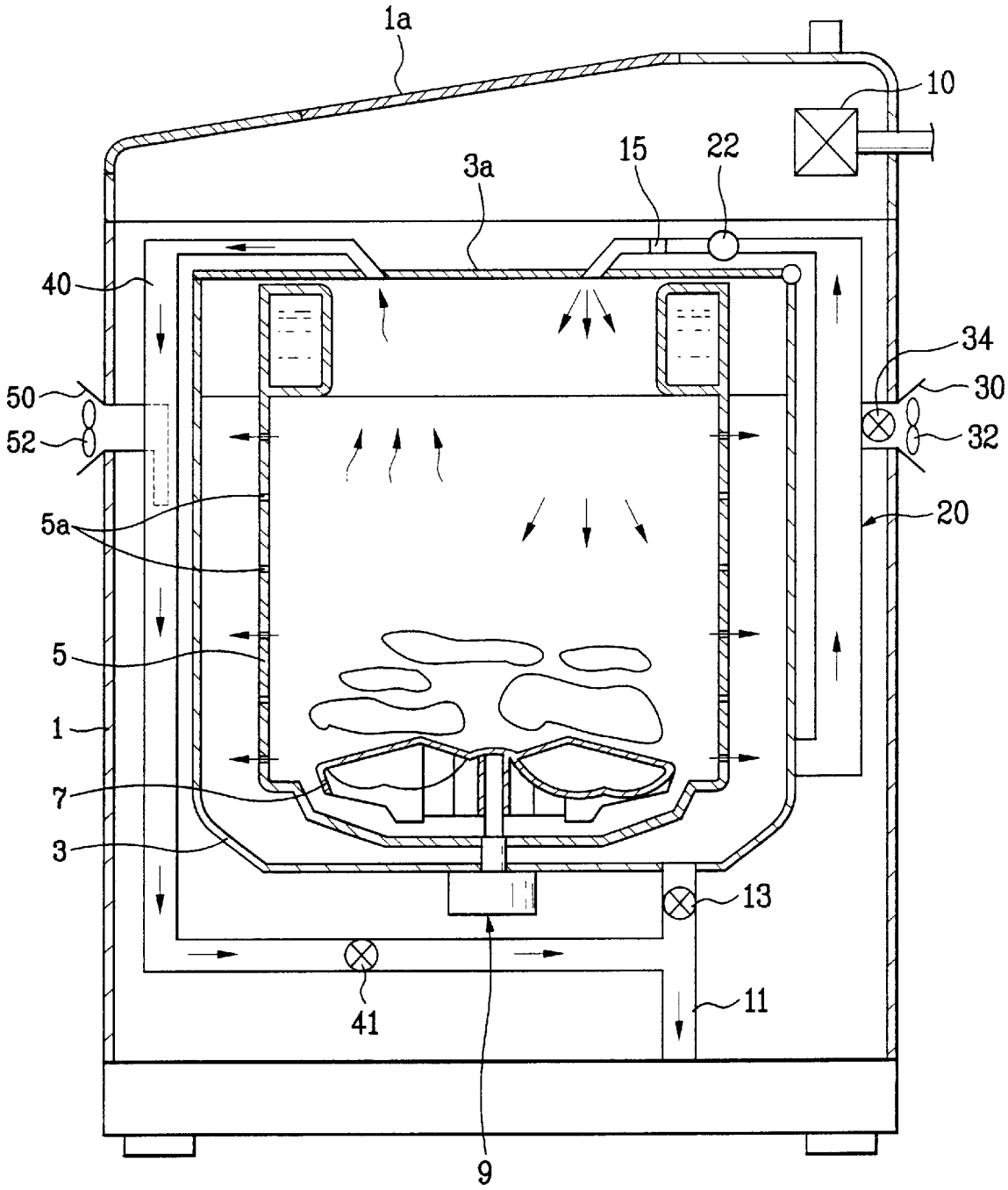
FIG. 1 illustrates a section of a washing and drying machine in accordance with a preferred embodiment of the present invention, schematically.
Figure 2A:
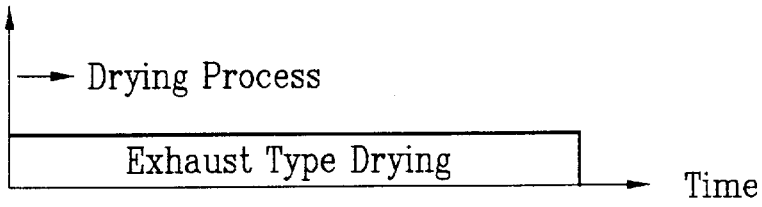
FIGS. 2A–2C illustrate graphs showing a principle of a method for controlling a drying process of a washing and drying machine of the present invention.
Figure 2B:
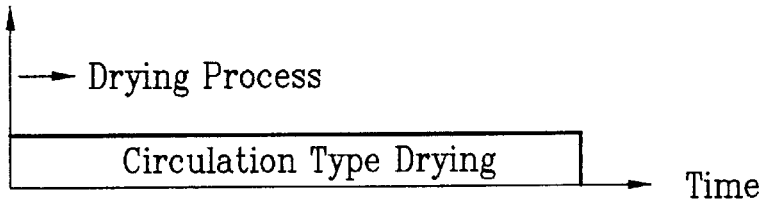
Figure 2C:
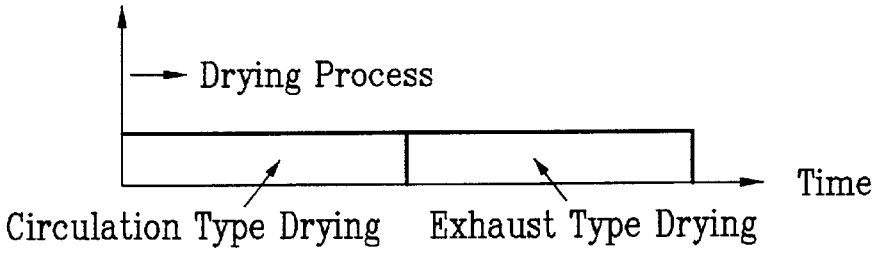

Reference will now be made in detail to the preferred embodiments of the present invention, examples of which are illustrated in the accompanying drawings. The washing and drying machine will be explained, with reference to FIG. 1.

At first, components for washing laundry will be explained.

There are an outer tub 3 inside of a washing machine case 1 for storage of washing water, an inner tub 5 having a plurality of through holes 5*a* rotatably fitted inside of the outer tub 3, and a pulsator 7 rotatably fitted inside of the inner tub 5. The inner tub 5 and the pulsator 7 are rotated by driving means 9 fitted to a bottom of the outer tub 3.

In the meantime, there is a water supply valve 10 in an upper part of the case 1 for supplying water for washing and rinsing, to which a water supply duct (not shown) for supplying water to the inner tub 5 is connected. There is a drain duct 11 connected to an underside of the outer tub 3 for draining dirty water to an outside of the washing machine after washing is finished. There is a drain valve 13 fitted to the drain duct 11. An unexplained reference symbol 1*a* denotes a washing machine cover.

Next, components for drying the laundry will be explained.

There is a circulation duct 20 between an upper part and a lower part of the outer tub 3 for supplying heated air into the inner tub 5 for drying laundry. Of course, there are a heater 15 for heating air, and a blower 22 for forced circulation of the air, fitted to the circulation duct 20.

In the meantime, there is a closable inner cover 3 an air tightly fitted to a top of the outer tub 3 for prevention of air leakage. It is preferable that a fore end of the circulation duct 20 is connected to the inner cover 3*a*, and a lower end of the circulation duct 20 is connected to a side surface of the outer tub 3. Of course, the lower end of the circulation duct 20 may be connected to an underside of the outer tub 3, when it is preferable that a connection duct (not shown) is fitted between a lower part of the circulation duct 20 and the drain duct 11 for smooth flow of water condensed from the circulation duct 20 to the drain duct 11.

There are a first external air duct 30 connected to the circulation duct 20 for supplying external air, and a first external air fan 32 at an inlet of the first external air duct 30 for generating a suction force for drawing external air, and a suction valve 34 fitted to the first external air duct 30 for cutting off air flow, selectively.

Since the air discharged to the circulation duct 20 after drying the laundry in the inner tub 5 is hot and humid, it is preferable that the moist contained in the air is removed because circulation of such hot and humid air as it is drops a drying efficiency. Therefore, it is preferable that there is dehumidifying means fitted to the circulation duct 20. As the dehumidifying means, there may be an air cooling type dehumidifying means in which cooling fins are fitted to an outer surface of the circulation duct 20 for removal of the moist, or water cooling type dehumidifying means in which cooling water is supplied to the circulation duct 20 for removal of the moist. Or alternatively, the external air from the first external air fan 32 is supplied to the circulation duct 20, for heat exchange between the external air at a relatively low temperature and the hot and humid circulation air, for removal of the moist.

For smooth dry, it is preferable that a portion of excessively humid vapor formed at a top part of the inner tub 5 is discharged. Accordingly, to do this, there is an air discharge duct 40 fitted to the top part of the outer tub 3. That is, one end of the air discharge duct 40 is connected to the inner cover 3*a*, and the other end of the air discharge duct 40 is preferably connected to the drain duct 11, though the other end may be opened to the air, directly. In this instance, the air discharge duct 40 also serves as a drain for discharging overflowing washing water during washing.

Moreover, since it is not desirable that the excessively humid air is discharged to the air as it is through the air discharge duct 40, a temperature and a humidity of the excessively humid air are dropped to some extents before the excessively humid air is discharged to the air. Accordingly, there is a second external air duct 50 connected to the air discharge duct 40 for drawing in external air, preferably with a second external air fan 52 fitted to an inlet to the second external air duct 50.

Also, in view of a structure, though only a portion of the air flows from the inner tub to the air discharge duct 40 if the first external air fan 32 is not operative, a supplementary valve 41 may be fitted to the air discharge duct 40 for perfect open/close of the air discharge duct 40, if necessary.

The operation of the foregoing washing and drying machine will be explained, briefly. At first, a washing process will be explained.

The washing process is identical to the related art washing machine, actually. That is, washing, rinsing, and spinning are carried out in succession, for washing the laundry. Upon completion of the washing and spinning, a drying process is started.

In the drying process, the heater 15 and the blower 22 are put into operation, to heat air and supply to the inner tub 5. The heated air 5 introduced into the inner tub 5 makes heat exchange with the laundry, to dry the laundry.

The drying process will be explained in detail with reference to FIG. 1.

The drying process is a step in which the heater 15 and the blower 22 are put into operation, to supply heated air to the inner tub 5 for drying the laundry, actually. There may be a variety of drying processes, which will be explained.

A method may be used, in which ducts connected to the outer tub 3 are left open actually, and heated air is supplied to the inner tub 5. (hereafter called as "exhaust type drying"). That is, in the exhaust type drying, the suction valve 34 and the drain valve 13 are opened, to open the first external air duct 30 and the drain duct 11 respectively, and the first external air fan 32 fitted to the first external air duct 30 is driven, for supplying the heated air to the inner tub 5. This type has a problem of causing an environmental problem since high temperature, and highly humid air is discharged to outside of the washing machine as it is.

Next, a method may be used; in which heated air is circulated to the inner tub 5 through the circulation duct 20, continuously (circulation type drying). That is, in the circulation type drying, the first external air duct 30 and the drain duct 11 are closed, in the air circulation. It is preferable that air is removed therefrom, appropriately. Though this type of drying method can reduce the environmental problem to some extent, this type of drying method has a slow drying speed.

Next, a method may be taken into consideration, in which the circulation type drying and the exhaust type drying are mixed in a sequence. That is, the drying process period is divided, to progress the circulation type drying at first, and the exhaust type drying at the next. Though this type of drying method can reduce the environmental problem, this type of drying method has a disadvantage of a slow drying rate as before because the circulation type drying that has a low drying rate is employed in a period the drying efficiency is the best.

Figure 3:
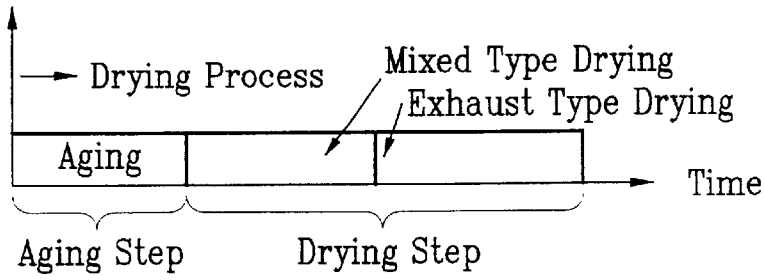
FIG. 3 illustrates a graph showing a principle of a method for controlling a drying process of a washing and drying machine in accordance with a preferred embodiment of the present invention.

A method for controlling a drying process in accordance with a preferred embodiment of the present invention will be explained, with reference to FIG. 3.

The drying process in accordance with a preferred embodiment of the present invention includes an aging step and a drying step in which the laundry is dried. It is preferable that, in the drying step, a mixed type drying is employed in which other drying methods are mixed with the circulation type drying method.

The aging step is a step in which the inner tub 5 is substantially enclosed and heated for elevating an inner tub 5 temperature and a laundry temperature in the inner tub 5 within a short time period. The aging step provides an environment favorable for evaporation of water vapor at actual starting the drying step because the elevated laundry and inner tub 5 temperatures cause greater amounts of evaporation and inner saturation vapor.

In the mixed type drying, the drying is substantially progressed by the circulation type drying, but a process for discharging excessively humid vapor and a process for discharging condensed water are carried out during the drying at fixed intervals.

In detail, the first external air duct 30 and the drain duct 11 are closed, for circulating air in the inner tub 5 to the inner tub 5 again, for drying the laundry, and, on the same time, the vapor is removed from the circulating air.

That is, the circulating type drying is carried out substantially, except that the process for discharging excessively humid air is carried out in which the first external air duct 30 is opened, and the drain duct 11 is closed, at fixed intervals during the circulation type drying, for discharging a portion of excessively humid air in the inner tub 5 through the air discharge duct 40. It is preferable that the process for discharging excessively humid air is carried out at 3–10 minute intervals for approx. 30–60 seconds. It is more preferable that the second external air fan 52 is put into operation during the process for discharging excessively humid air, for introducing external air into the air discharge duct 40, for causing heat exchange between the external air and the excessively humid air, to drop a temperature and a humidity of the discharged excessively humid air.

The water vapor in the air introduced into the circulation duct 20 is removed by means of an appropriate humidity removing means, to form condensed water. Therefore, a process for draining condensed water is carried out in which the drain duct 11 is opened at fixed intervals, for draining the condensed water formed in the drying step. It is preferable that the process for draining condensed water is carried out at 10–15 minute intervals for approx. 10–30 seconds.

In the meantime, after the mixed type drying is finished, it is preferable that the exhaust type drying is carried out. That is, the first external air duct 30 and the drain duct 11 are opened, and the first external air fan 32 is put into operation.

Figure 4:
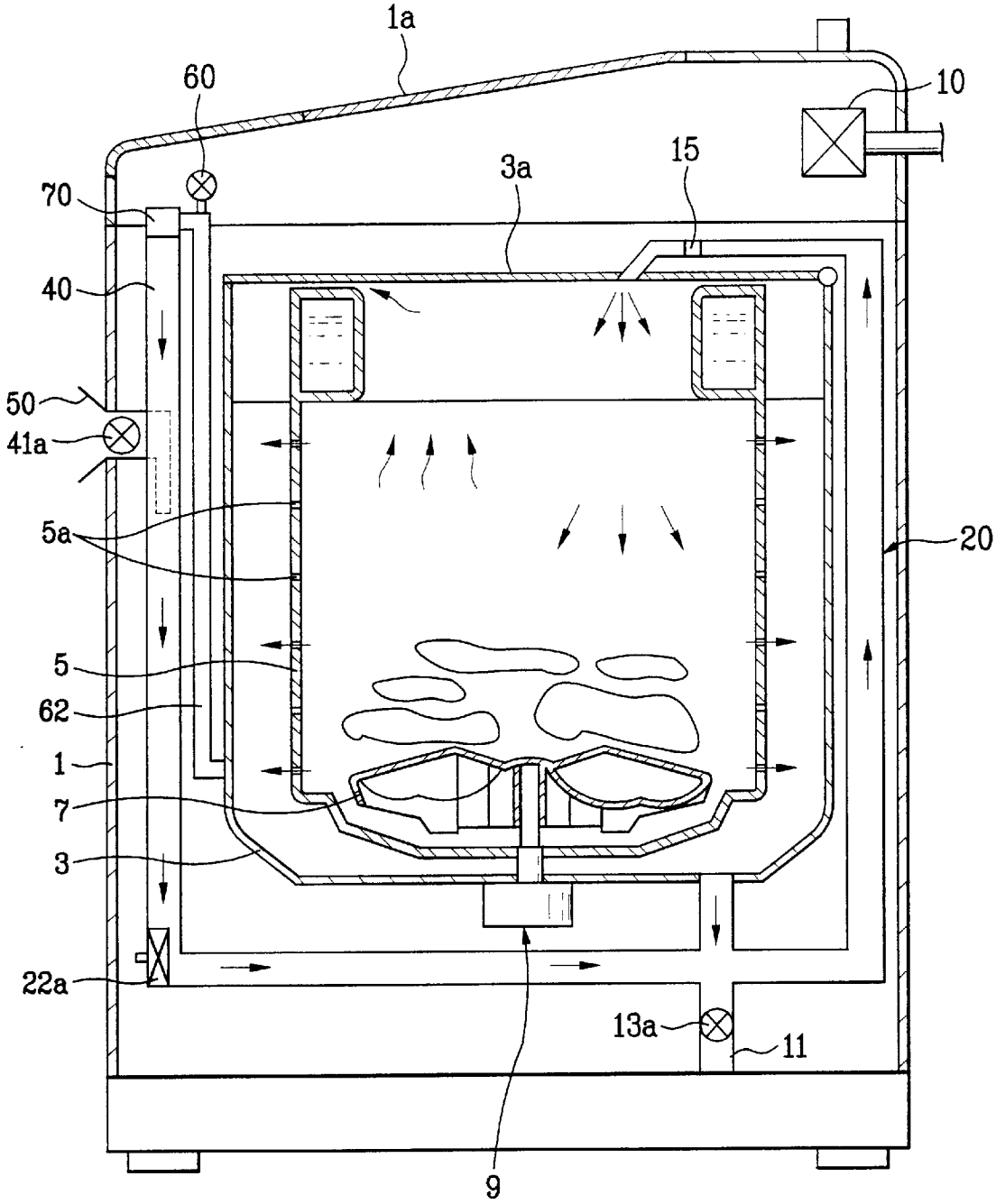
FIG. 4 illustrates a section of a washing and drying machine in accordance with another preferred embodiment of the present invention, schematically.

A washing and drying machine in accordance with another preferred embodiment of the present invention will be explained, with reference to FIG. 4. In explaining this embodiment, parts the same with the foregoing embodiment will be given the same names and reference symbols, and detailed explanation of which will be omitted. The washing and drying machine of this embodiment is the same with the foregoing embodiment washing and drying machine, substantially. Differences of this embodiment from the foregoing embodiment will be explained.

The circulation duct 20 is connected to the drain duct 11, directly. It is preferable that the drain valve 13*a* is fitted to a location in rear of a part the circulation duct 20 and the drain duct 11 are crossed. The first external duct in the foregoing embodiment may not be provided. It is preferable that an air circulation valve 41*a* is fitted to the drain duct 40.

In the foregoing embodiment, the temperature and humidity of the high temperature, and highly humid vapor is regulated by air cooling method before being discharged to outside. That is, external air is received, and heat exchange between the received external air and the water vapor is made, for regulating the temperature and humidity of the discharged air. In the present embodiment, water cooling and air cooling are combined for a more effective regulation of the temperature and the humidity of the discharged water vapor. Of course, water cooling may only be employed. In detail, there is a water cooling valve 60 at a top of the air discharge duct 40 for selective regulation of water supply. Of course, it is preferable that the water cooling valve 60 is connected to the water supply valve 10. Though the water cooling valve 60 may be connected to the air discharge duct 40 directly, it is preferable that a separate water cooling duct 62 is provided, and the water cooling valve 60 is connected to the water cooling duct 62. That is, one end of the water cooling duct 62 is connected to a lower part of the outer tub, and the other end of the water cooling duct 62 is connected to the air discharge duct 40. it is more preferable that a filter 70 is fitted to a connection part of the air discharge duct 40 and the water cooling duct 62.

In the meantime, it is preferable that a fan 22*a* is fitted to the air discharge duct 40 for smooth discharge of water vapor. If the circulation duct 20 is directly connected to the drain duct 11 the same as this embodiment, no fan may be fitted to the circulation duct 20, because the air in the inner tub can be circulated through the circulation duct 20 even if the fan 22*a* is fitted only to the air discharge duct 40 as the circulation duct 20 is connected to the air discharge duct 40 through the drain duct 11.

Figure 5:
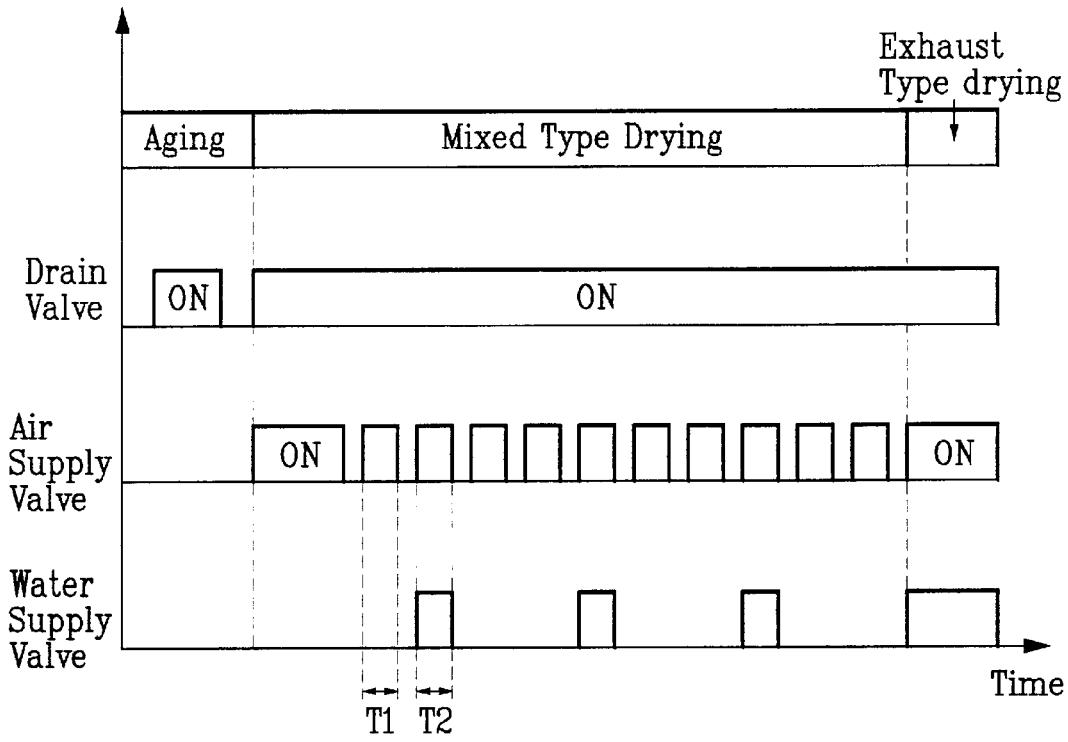
FIG. 5 illustrate a graph showing an exemplary method for controlling a drying process of a washing and drying machine in FIG. 4.

A method for controlling a drying process of a washing and drying machine in accordance with a preferred embodiment of the present invention will be explained, with reference to FIGS. 4 to 6. The drying process includes a preheating step and a drying step.

Figure 6:
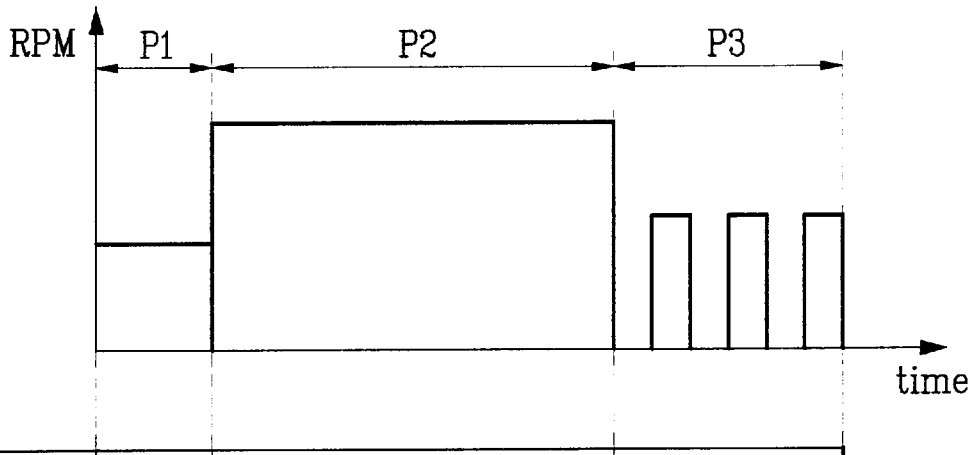
FIG. 6 illustrates a graph showing a pre-heating step in a drying process of a washing and drying machine of the present invention.

Referring to FIG. 6, the preheating step will be explained in more detail.

As explained, the preheating step is a step for elevating a temperature of the inner tub 5 within a short time period in an initial stage of the drying process. Therefore, it is preferable that the inner tub 5 is rotated at an appropriate speed in the preheating step. That is, in an initial stage of the preheating, the inner tub 5 is rotated at a slow speed for a time period P1, and, next, the inner tub 5 is rotated at a fast speed P2 for a time period. Then, stopping and rotating of the inner tub 5 is repeated, for stirring the laundry P3. As explained in the foregoing embodiment, it is preferable that all valves are turned off actually for minimizing heat loss in the preheating step. For an example, in this embodiment, the air circulation valve 41*a* and the water cooling valve 60 are turned off in the preheating step. However, though the drain valve 13*a* may be turned off, since there may be water from the laundry in the step the inner tub 5 rotates at a fast speed, it is preferable that the drain valve 13*a* is turned on for draining the water from the laundry to outside of the washing machine.

Next, the drying step will be explained.

The drying step in this embodiment may also employ the mixed type drying explained in the foregoing embodiment. That is, in the mixed type drying, though the drying is actually carried out by the circulation type drying, excessively humid vapor is discharged to outside at fixed intervals, and the condensed water may also be discharged during drying.

However, in this embodiment, the foregoing mixed type drying is varied slightly. In detail, in the drying step, a portion of air heat exchanged with the laundry in the inner tub 5 is circulated through the inner tub 5 again, for drying the laundry, and a portion of the air in the inner tub 5 is discharged to outside of the washing machine. That is, in this embodiment, since, of the air heat exchanged with the laundry in the inner tub 5, a portion is circulated, and a portion is discharged, it is preferable that the drain valve 13*a* is opened in the drying step. Of course, a separate discharge air passage may be provided, to open the passage while the drain valve 13*a* is turned off.

In the meantime, it is preferable that a temperature and a humidity of the air discharged to an outside are regulated, appropriately. The regulation of the temperature and the humidity of the air may be made by means of appropriate temperature/humidity regulating means. Air cooling, or water cooling may be used, or the air cooling and the water cooling may be carried out in parallel.

In this embodiment, the air circulation valve 41*a* is turned on/off periodically, so that the excessively humid air is discharged to outside with the temperature and the humidity regulated. For more effective regulation of the temperature and humidity of the excessively humid air, the water cooling valve 60 is turned on/off periodically. The turn on/off period of the water cooling valve 60 may be made to be the same with the turn on/off period of the air circulation valve 41*a*, it is preferable that the air circulation valve 41*a* and the water circulation valve 60 are opened on the same time only in a period the temperature and the humidity of the discharge vapor are high. Therefore, it is preferable that only the air circulation valve 41*a* is opened in a certain period T1, for regulating the temperature/humidity of the air discharged to outside by the air cooling method, and the air circulation valve 41*a* and the water cooling valve 60 are opened in a certain period T2, for regulating the temperature/humidity of the air discharged to outside more effectively by the air cooling method and the water cooling method.

In the meantime, it is required that condensed water formed in the process the temperature and humidity of the air discharged to outside are regulated is drained to outside of the washing machine. That is, it is required that the drain valve 13*a* is opened appropriately, for draining the condensed water to outside through the drain duct 11. Though intermittent opening of the drain valve 13*a* is possible, it is preferable that the drain valve 13*a* is opened, continuously.

In the meantime, it is preferable that all valves are opened in an end stage of the drying process, i.e., in the air discharging drying step, to discharge air in the inner tub 5 to outside. In this time, it is more preferable that the heater 15 is not put into operation.

The method for controlling a drying process of a washing and drying machine of the present invention is applicable, not limited to the washing and drying machine explained in the specification, but to other washing and drying machine.

The method for controlling a drying process of a washing and drying machine of the present invention has the following advantages.

Advantages of the method for controlling a drying process of a washing and drying machine of the present invention will be explained.

The preheating of the laundry and the inner tub before a drying process is started improves a drying performance. Moreover, the taking of an optimum drying step permits to speed up the drying, and the discharge of water vapor to outside in a state a temperature/a humidity thereof are dropped reduces environmental problems.

It will be apparent to those skilled in the art that various modifications and variations can be made in the washing and drying machine and a method for controlling a drying process thereof of the present invention without departing from the spirit or scope of the invention. Thus, it is intended that the present invention cover the modifications and variations of this invention provided they come within the scope of the appended claims and their equivalents.

What is claimed is:

1. A method for controlling a drying process of a washing and drying machine comprising:

a preheating step for tightly closing and heating an inner tub without air circulation for preparing an environment favorable for vaporization of water by elevating a temperature of the inner tub within a short time period; and a drying step for supplying heated air to the inner tub with air circulation, to make heat exchange between the heated air and laundry, for drying the laundry.

2. A method as claimed in claim 1, wherein the washing and drying machine includes:

a circulation duct for circulating air in the inner tub, a drain duct for draining washing water in the inner tub, and an air discharge duct for discharging excessively humid air in the inner tub, and the drying step includes the step of;

a circulating type drying process for closing the drain duct to circulate the air from the inner tub to the inner tub again to dry laundry, and, on the same time, removing water vapor contained in the circulating air.

3. A method as claimed in claim 2, wherein the drying step further includes an excessively humid air discharge step for discharging a portion of the excessively humid air from the inner tub to outside through the air discharge duct at fixed intervals.

4. A method as claimed in claim 3, wherein the excessively humid air discharge step includes the step of dropping a temperature and a humidity of the excessively humid air to be discharged.

5. A method as claimed in claim 2, wherein the drying step further includes a condensed water draining step for opening the drain duct at fixed intervals for draining condensed water produced in the drying step to outside.

6. A method as claimed in claim 2, wherein the drying step further includes an air discharge drying step for receiving external air through the circulation duct, and discharging the received air to outside of the washing machine through the inner tub directly.

7. A method as claimed in claim 1, wherein the preheating step includes:

a low speed rotating step for rotating the inner tub at a low speed, a high speed rotating step for rotating the inner tub at a high speed, and a stirring step for rotating the inner tub, periodically.

8. A method as claimed in claim 7, wherein the high speed rotating step includes the step of opening the drain duct.

9. A method as claimed in claim 1, wherein the drying step includes the steps of:

circulating a portion of air from the inner tub to the inner tub again for drying the laundry, and discharging a portion of the air in the inner tub to an outside of the washing machine.

10. A method as claimed in claim 9, wherein the air to be discharge to an outside of the washing machine is subjected to regulation of a temperature and a humidity thereof.

11. A method as claimed in claim 10, wherein the regulation of a temperature and a humidity is made by using external air introduced thereto.

12. A method as claimed in claim 10, wherein the regulation of a temperature and a humidity is made by using cooling water introduced thereto.

13. A method as claimed in claim 9, wherein the drying step further includes an air discharge drying step for receiving external air, and discharging the received air to outside of the washing machine through the inner tub, directly.

14. A method as claimed in claim 13, wherein the air to be discharge to an outside of the washing machine is subjected to regulation of a temperature and a humidity thereof.

15. A method as claimed in claim 14, wherein no air is heated in the air discharge drying step.

16. A method as claimed in claim 9, wherein the preheating step includes:

a low speed rotating step for rotating the inner tub at a low speed, a high speed rotating step for rotating the inner tub at a high speed, and a stirring step for rotating the inner tub, periodically.

17. A method as claimed in claim 16, wherein the high speed rotating step includes the step of opening the drain duct.

18. A washing and drying machine of a pulsator type comprising:

a drain duct connected to an underside of an outer tub;

a circulation duct having one end positioned in the vicinity of an upper part of the outer tub, and the other end connected to the drain duct;

a heater fitted to a predetermined location of the circulation duct for heating air flowing through the circulating duct;

an air discharge duct having one end located in the vicinity of the upper part of the outer tub, and the other end connected to the drain duct;

a fan fitted to a predetermined location of the air discharge duct for forced circulation of air; and temperature/humidity regulating means fitted to the air discharge duct for regulating temperature/humidity of the air flowing through the air discharge duct.

* * * * *